United States Patent [19]

Bolli et al.

[11] Patent Number: 4,992,069

[45] Date of Patent: Feb. 12, 1991

[54] BUILDING SET HAVING PLUG-IN BUILDING BLOCKS FOR BUILDING IN LAYERS

[75] Inventors: Peter Bolli, Steinhausen; Heinz Looser, Baar, both of Switzerland

[73] Assignee: Interlego A.G., Switzerland

[21] Appl. No.: 424,532

[22] Filed: Oct. 20, 1989

[30] Foreign Application Priority Data

Oct. 25, 1988 [CH] Switzerland ..... 3961/88

[51] Int. Cl.[5] ..... A63H 33/08; A63H 3/52; E04G 7/00; E04B 1/00

[52] U.S. Cl. ..... 446/128; 446/476; 403/49; 182/178; 182/179; 52/286; 52/593

[58] Field of Search ..... 52/286, 598, 593; 446/128, 125, 126, 124, 123, 122, 121, 120, 116, 115, 111, 110, 107, 106, 105, 476, 478, 477; 182/178, 179; 403/49, 169

[56] References Cited

U.S. PATENT DOCUMENTS

| | | | |
|---|---|---|---|
| 1,034,338 | 7/1912 | Beatty | 182/178 |
| 2,810,233 | 10/1957 | Jakobsen | 446/126 |
| 2,885,822 | 5/1959 | Onanian | 446/122 X |
| 3,371,458 | 3/1968 | Sturgill | 446/126 X |
| 4,171,590 | 10/1979 | Fischer | 446/122 |
| 4,637,180 | 1/1987 | Zeigler | 446/121 X |
| 4,676,762 | 6/1987 | Ballard | 446/124 X |

FOREIGN PATENT DOCUMENTS

| | | | |
|---|---|---|---|
| 2315343 | 3/1973 | Fed. Rep. of Germany | 446/120 |
| 3306887 | 8/1984 | Fed. Rep. of Germany | 446/122 |
| 3503211 | 8/1986 | Fed. Rep. of Germany | 446/126 |
| 8503134 | 6/1987 | Netherlands | 446/121 |
| 385086 | 2/1965 | Switzerland | 446/128 |

*Primary Examiner*—Robert A. Hafer
*Assistant Examiner*—D. N. Muir
*Attorney, Agent, or Firm*—Kane, Dalsimer, Sullivan, Kurucz, Levy, Eisele and Richard

[57] ABSTRACT

In a square array with a modulus (M), the plug-in building blocks of the building set have protruding connecting pins (1) and corresponding mating connecting sockets. In order that bendproof trusses can also be built, the building set has single-row connecting bars (34) with two terminal pins (35), whose spacing from one another amounts to $\sqrt{2}$ times an integral multiple of the modulus (M), and girder elements (10), which at two bordering sides faces (13, 14) each have a single row of pins with modular spacing and parallel to these side faces each have a projection (19) set back by the thickness of the connecting bar (34). In this way, stable, aesthetically appealing trussings can be built with the building set.

31 Claims, 3 Drawing Sheets

11
22
14
21
15
M
19
18
M
M
a
a
5M
3M
20
1
24
17
19
21
M
23
13
12
16
10 a
a
20
19
18
1
11
15
16
20
17
21
22
19
47
36
14
10
13
a
45
35
34
a
45
2
1
46
1
44
2

35
3M√2
1
M
41
11
16
1
35
M
39
40
34
38
10'
19
10
1
17
1
IV
IV
29
14
31
13
28
30
12

11
22
14
21
15
M
19
18
M
M
a
a
5M
3M
20
1
24
17
19
21
M
23
13
12
16
10 a
a
19
20
18
1
11
15
16
20
17
21
22
19
14
13
10
47
36
a
45
35
34
a
45
2
1
46
1
2

35
44
3M√2
1
M
41
1
16
11
35
M
39
40
34
38
10'
10
19
1
17
1
IV
IV
14
13
12
29
31
28
30

BUILDING SET HAVING PLUG-IN BUILDING BLOCKS FOR BUILDING IN LAYERS

BACKGROUND OF THE INVENTION

The invention concerns a building set of plug-in building blocks for building in layers, having connecting elements which are arranged in a square array with a modulus, and having corresponding mating connecting means.

Such a building set is described in GB Patent No. 866,557, and is generally known. This is a toy which is very popular with children. However, the known building sets for building in layers are not suitable for making bendproof trusses.

A building block for connecting two mutually perpendicular walls is known from US Patent 4,270,303, FIG. 11. This building block is prismatic and has a row of connecting pins on each of two mutually perpendicular side walls. This building block, too, is not suitable for making bendproof trusses.

A similar building block is known from CH Patent No. 365,015, FIGS. 50 to 53.

SUMMARY OF THE INVENTION

It is the object of the present invention further to develop a building set of the type named above in such a way that it is also possible to make bendproof trusses therewith.

The building set according to the invention comprises girder elements, which have centering means on two opposite end faces for centering with further girder elements which join at the end faces, and at least one row each of connecting elements with modular spacing on two first side faces.

BRIEF DESCRIPTION OF THE DRAWINGS

Illustrative embodiments of the invention are explained below with reference to the drawings, in which.

DETAILED DESCRIPTION OF THE PREFERRED EMBODIMENT

The building blocks represented in FIGS. 1 to 9 are intended for a box of building blocks for building in layers, which is based on a square array of the modulus M, and the building blocks of which have, in the modular spacing, connecting pins 1 and mating connecting means 2 adapted thereto. The principle of this building in layers is described in GB Patent No. 866,557.

Figure 1:
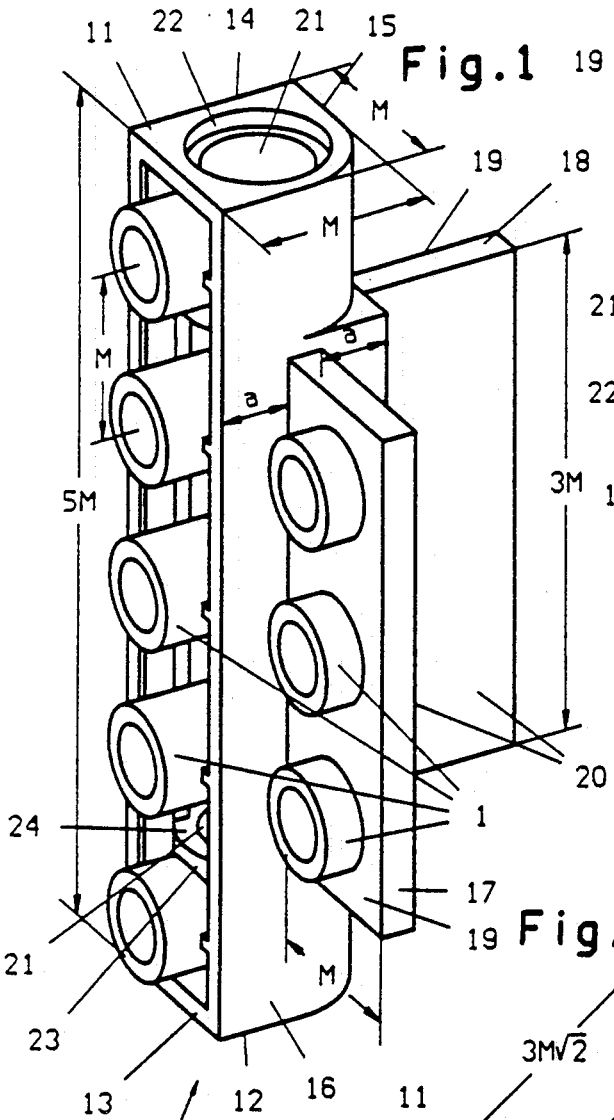
FIG. 1 shows a perspective view of a girder element.

FIG. 1 represents a girder element 10 for a trussing, injection-molded in one piece from plastic. The girder element 10 consists of an essentially prismatic hollow part of square cross-section having two opposite, parallel end faces 11, 12, arranged perpendicular to the longitudinal axis of the girder element and four side faces 13, 14, 15, 16 perpendicular to the end faces 11, 12. The width of the side faces 13 to 16 amounts to one modulus M, the length of the girder element 10 to 5 M. Along the mutually perpendicular side faces 13 and 14, a single row of five hollow cylindrical connecting pins 1 protrudes beyond the plane of the side faces 13 and 14. The pins 1 have a regular spacing of lM from one another. A parallelepiped-shaped projection 17, 18 of length 3 M and width 1 M sticks out from each of the side faces 15, 16. The front face 19 of the projections 17, 18 is set back by an amount a with respect to the side faces 13 or 14 parallel to it, and carries three further hollow cylindrical connecting pins 1 each. The rear face 20 of the projections 17, 18 has the same spacing a from the parallel side face 15, 16. At the end face, the girder element 10 has one cylindrical center bore 21 each with a cylindrical countersink 22 each. The bore 21 is constructed in a cylindrical receiver 23 which projects into the cavity of the girder element 10, and terminates in a radial collar 24. The axes of the bores 21 intersect the axes of the connecting pins 1 of the side faces 13, 14. The diameter of the bores 21 is equal to the diameter of the connecting pins 1. Consequently, the girder element 10 can, for example, be plugged onto a baseplate with the connecting pins 1.

The bores 21 serve to accommodate cylindrical plug elements 28 (FIG. 5) with a middle flange 29 and edge beads 30, which are resiliently flexible radially owing to axial slots 31. In the inserted state, half of the flange 29 lies in the countersink 22, and the edge bead 30 is snapped in behind the collar 24. A further girder element 10 can be plugged onto the half of the plug element 28 projecting from the bore 21. The girder elements 10 are centered with respect to one another, and connected to one another so as to withstand tension, within limits, by the plug elements 28.

Figure 2:
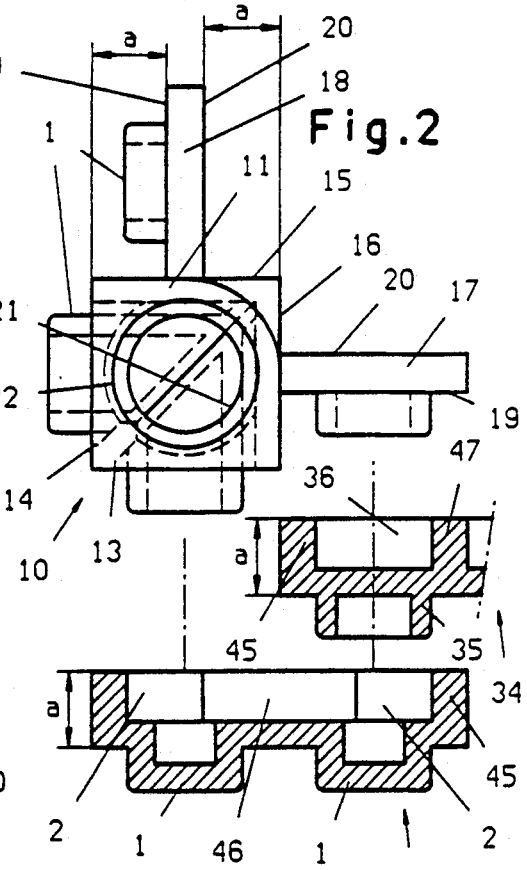
FIG. 2 shows an end view of the girder element according to FIG. 1 with a connecting bar and a building block.
Figure 3:
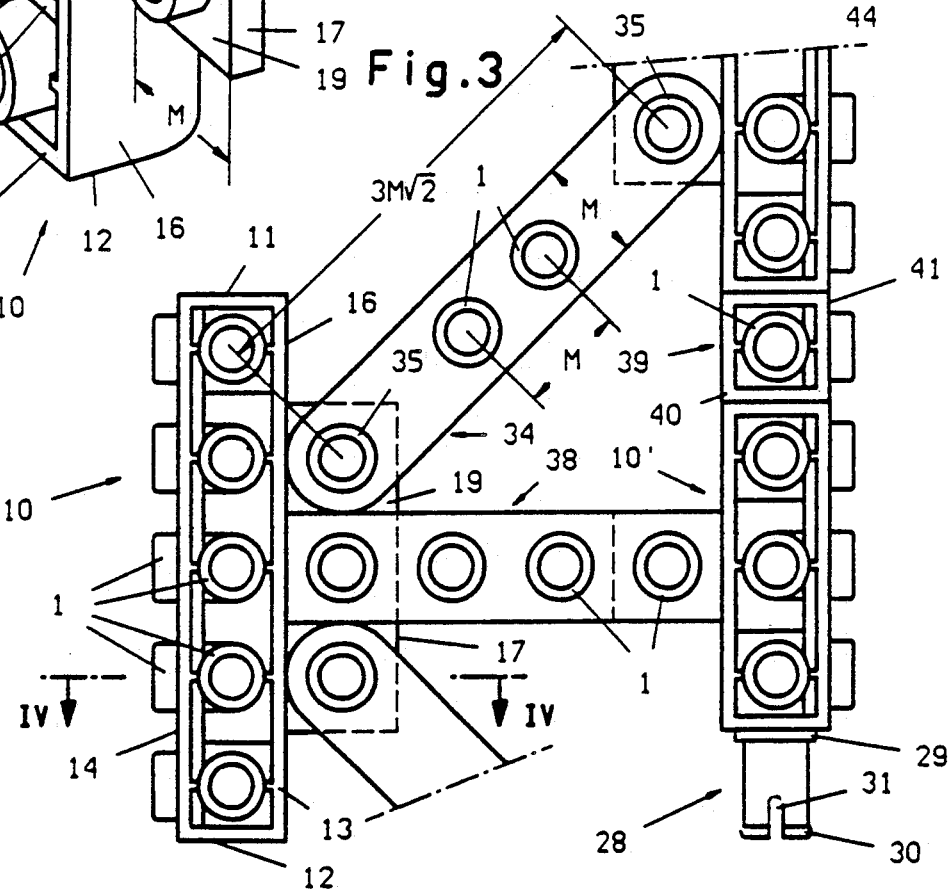
FIG. 3 shows a side view of a part of a trussing.
Figure 1:
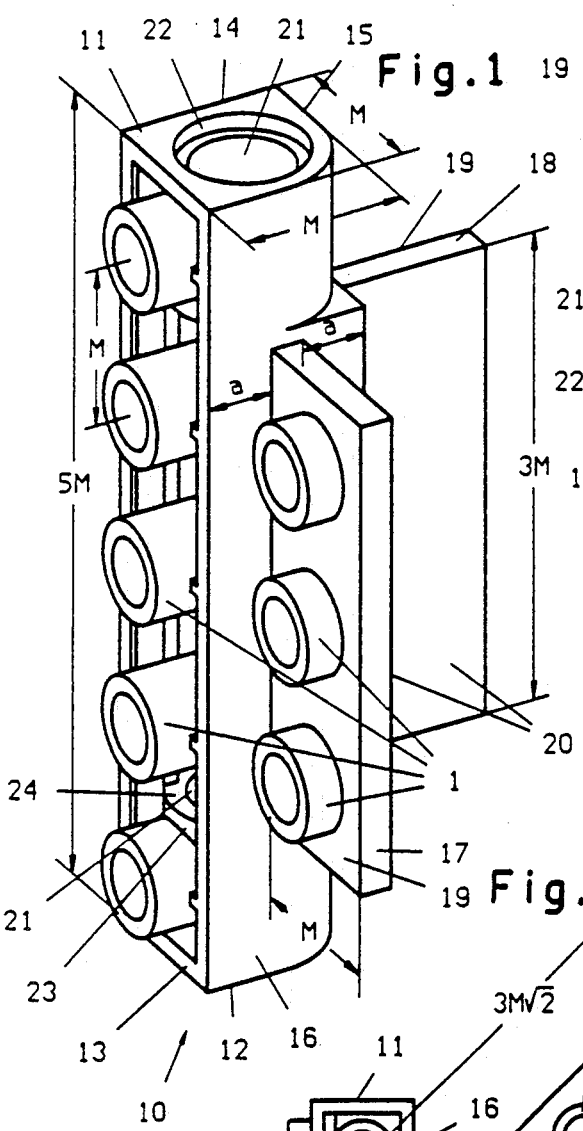
Figure 2:
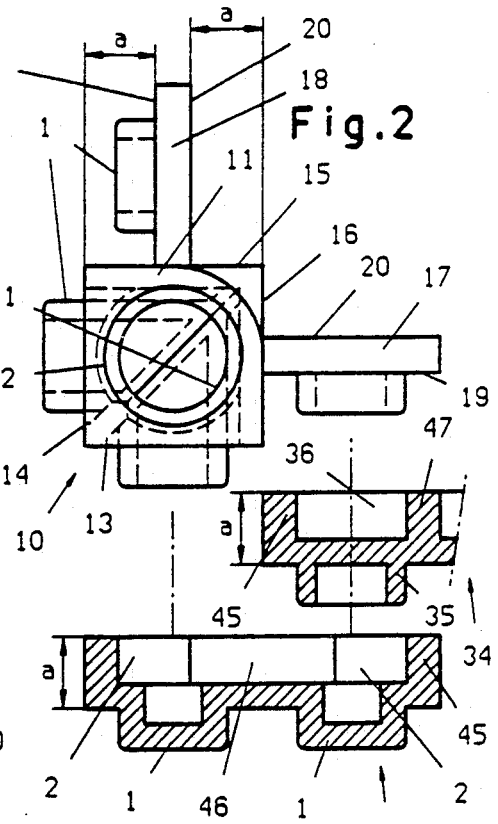
Figure 3:
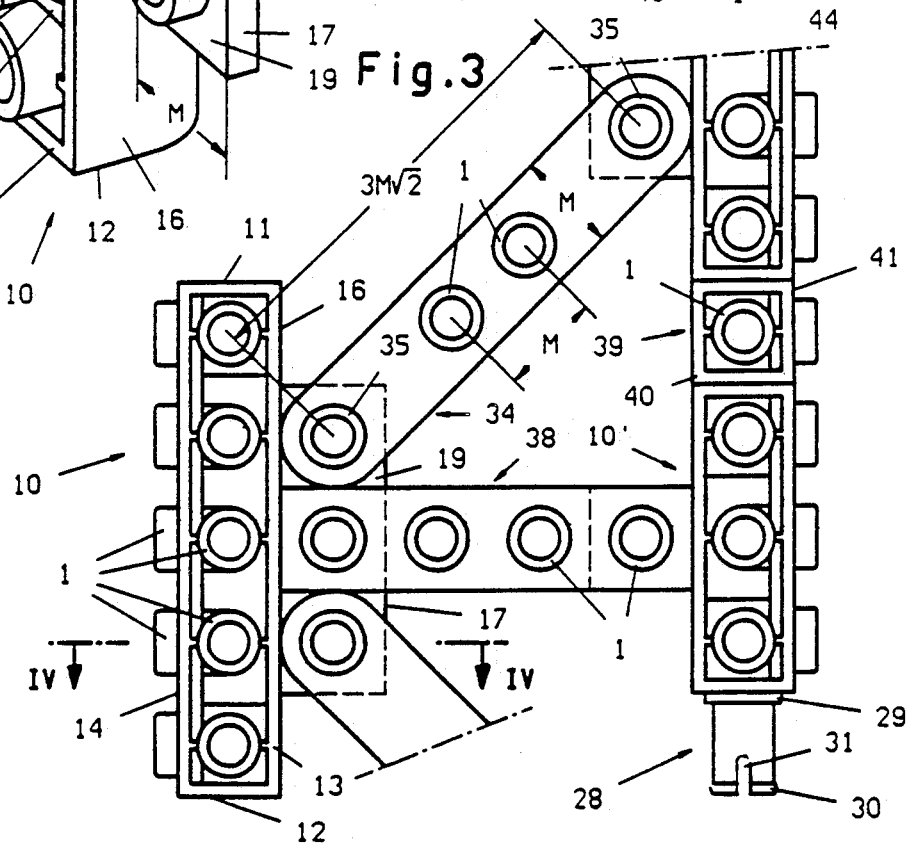

FIGS. 2 and 3 represent the construction of a trussing with the girder elements 10 and connecting bars 34. The connecting bars 34 have the width M and two terminal pins 35 sticking out in the direction of the thickness, and corresponding, coaxial mating connecting means 36. The terminal pins 35 have a spacing of $\sqrt{2}$ times an integral multiple n of the modulus M from one another, in the example represented 3 M $\sqrt{2}$. The thickness of the connecting bars 34 approximately corresponds to the distance a between side face 13 and front face 19. The ends of the connecting bars 34 are rounded coaxially with the terminal pins 35. In the case of the connecting bar 34 of length 3 M $\sqrt{2}$ +M, two further pins 1 are arranged with modular spacing from one another symmetrical to the middle plane. During building, these pins facilitate the choice of the correct length of connecting bar, if the building set has bars 34 of different length: the number of pins corresponds to that of a building block 38 (FIG. 3), which is arranged perpendicular to the extent of the girder and spans the same width, that is to say to the number of modular spacings between the girders.

In FIG. 3, the girders are assembled from the girder elements 10 represented in FIGS. 1 and 2, from analogous but shorter girder elements 10', and from further girder elements 39, which are constructed without the projections 17 or 18. The side faces 40, 41 of these girder elements 39 which are provided with pins, form the same angle, a right angle in the case represented, with one another as the side faces 13 or 14 of the girder element 10. The cross-section of the girder elements 39 corresponds to the cross-section of the terminal sections of the girder elements 10, 10' outside the projections 17, 18. The girder element 10' is connected to the opposite girder element 10 by a plug-in building block 38 of length 4 M, width M and thickness a. This building block 38 has four pins 1 and corresponding mating connecting means 2.

Flat building blocks 44 with 2×3 or 1×2 pins 1 and mating connecting means 2 are further plugged onto the trussing joints, that is to say onto the junctions of girder elements 10, 10' and connecting bars 34 or building blocks 38, and this substantially reinforces these joints. The mating connecting means 2, 36 are formed by the circumferential wall 45 of the building block 44 and two hollow pins 46 or a full pin 47 in case of the connecting bars 34. On being plugged in, the connecting pins 1 are jammed between these pins 46 or 47 and the wall 45. Single-row, flat building blocks of the type of building block 38, which reinforce the connection of the girder elements to one another, especially transfer the tensile forces in the girder, and form a continuous, unshouldered girder, are further plugged onto the girder elements 10, 10', 39 between the building blocks 44. In the example according to FIG. 3, these additional building blocks are 3 M long. If the right-angled struts formed by the building blocks 38 elements 10' and 39 are replaced by a longer girder element of the type of element 39.

Figure 4:
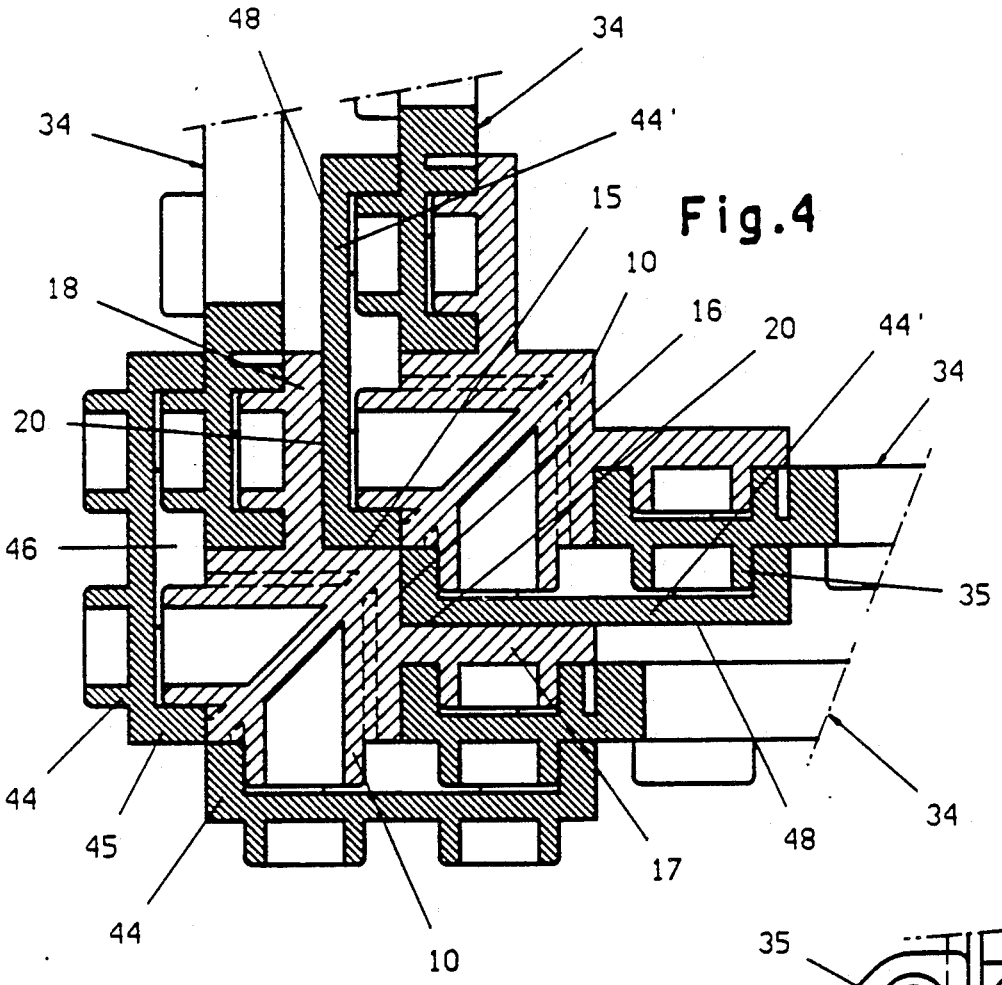
FIG. 4 shows a view along the line IV—IV in FIG. 3, with a second trussing which is telescopically displaceable along the first.

FIG. 4 shows a part section through two trussings of the type represented in FIG. 3, which can be displaced telescopically in one another. In the case of the inner of these two trussings, building blocks 44 and the single-row building blocks plugged between the building blocks 44 onto the girder elements 10, 10' and 39 are replaced by building blocks 44' without connecting pins, thus with a smooth, continuous surface 48. This surface 48 slides on the rear faces 20 of the projections 17, 18 of the girder elements 10 of the outer trussing. Moreover, the side faces of the building blocks 44' are led through the side faces 15, 16 of the girder elements 10.

Instead of providing the center bores 21 on both end faces 11, 12, it is also possible for the purpose of centering to allow a connecting pin 1 to protrude on one end face coaxial to the center bore on the opposite end face. This has the advantage that the plug elements 28 are dispensed with. On the other hand, the described configuration has the advantage that the connecting force is somewhat greater in tension, and that it is also possible for other components to be fastened with the plug elements. The configuration described is therefore more versatile in application.

Figure 5:
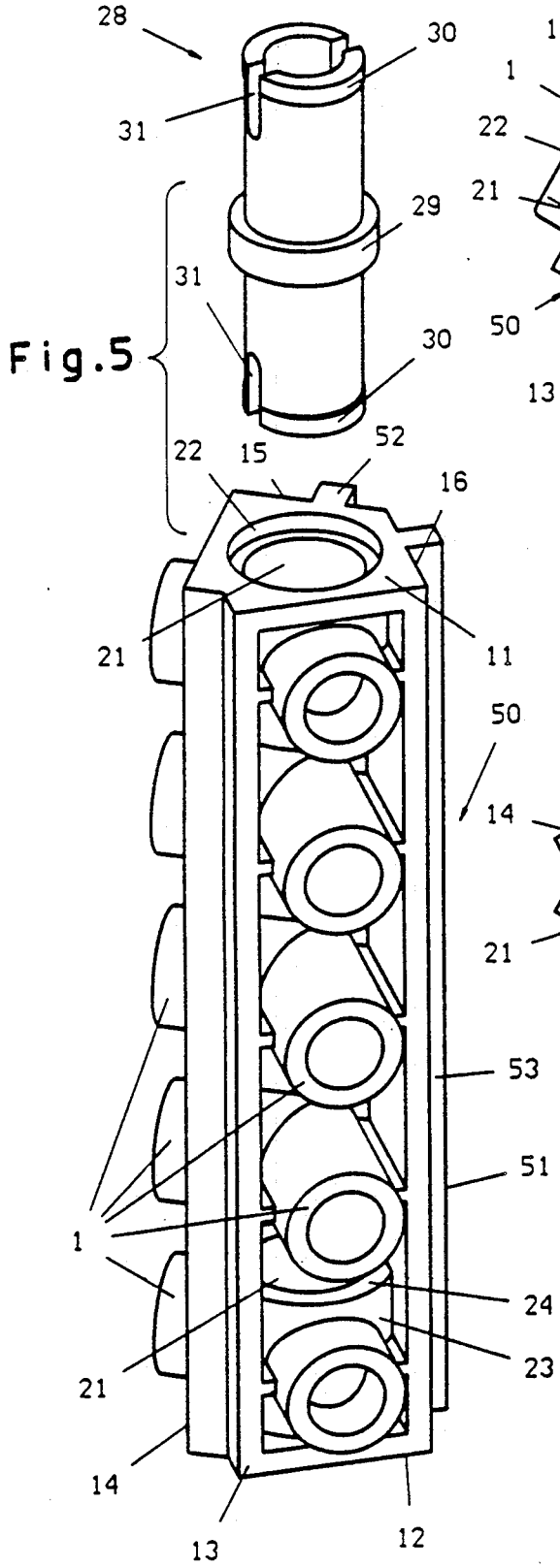
FIG. 5 shows a perspective view of a second embodiment of a girder element and of a plug element.
Figure 6:
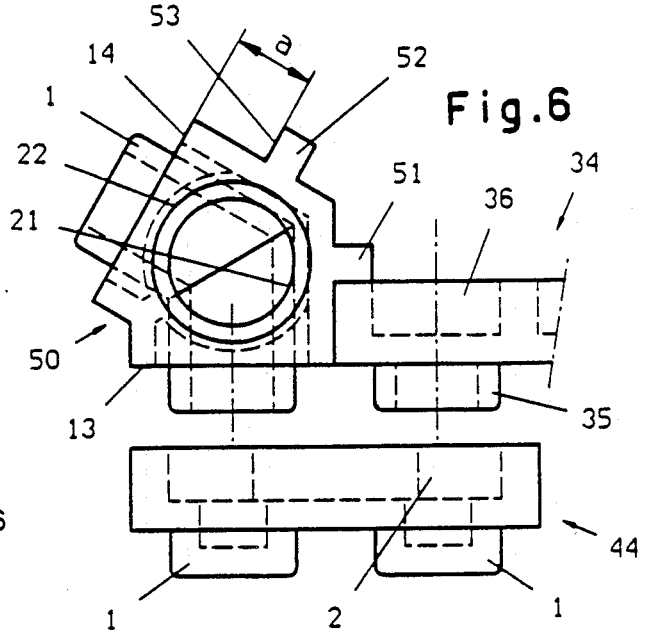
FIG. 6 shows an end view of the element according to FIG. 5 with a connecting bar and a building block.

FIGS. 5 and 6 represent a second embodiment of a girder element 50, the same reference symbols being used for analogous parts, so that there is no need for a detailed description. The girder element 50 likewise has two side faces 13, 14 of length 5 M with a single row of connecting pins 1 each. The side faces 13, 14 here form an angle of 60° with one another. These girder element 50 serve to build trussings with three girders. Here, the set-back projections 51, 52 with the front faces 53, which are parallel to the side faces 13, 14, are constructed to be smooth and continuous over the entire length of the girder element 50, and are essentially narrower than M. As FIG. 6 shows, they serve to bear the connecting bars 34. They facilitate the positioning of the connecting bars and the placing of the building blocks 44, and they also contribute to the transfer of force between connecting bar 34 and girder. The girder element 50 likewise has axial bores 21 for the plug elements 28. In this embodiment, in the case of the connecting bar 34 the mating connecting means 36 coaxial to the terminal pins 35 can be omitted.

The embodiment according to FIGS. 5 and 6 is aesthetically lighter and produces less massive joints. Moreover, fewer different individual parts are necessary for building a trussing. By contrast, in the embodiment according to FIGS. 1 to 3 larger forces can be transferred via the joints.

Figure 7:
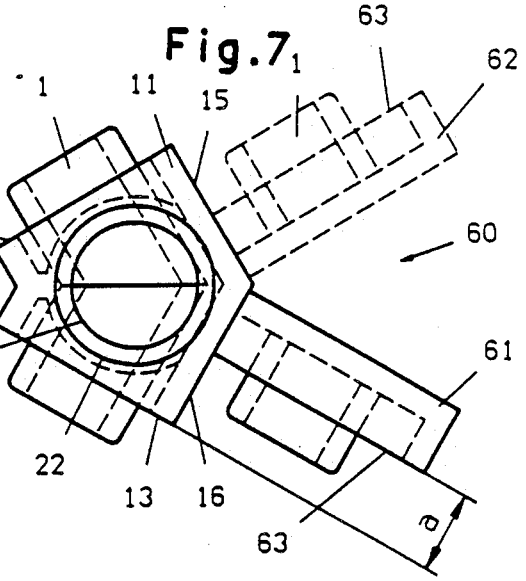
FIGS. 7 and 8 show end views of two further embodiments of girder elements.

The embodiment according to FIGS. 1 to 3 can also be constructed with three girders for building trussings. FIG. 7 shows the end view of the girder element 60 necessary for this. In turn, this has side faces 13, 14 with a single row of pins 1. The faces 13, 14 intersect at an angle of 60°. Shorter, set-back projections 61, 62, likewise with a row of three pins 1, on their front faces 63, are arranged on the side faces 15, 16. In the case of a trussing with three girders and connecting bars, which extend at 45° to the girders, the joints of one connecting bar plane on one of the three girders are offset in the direction of the length of the girder with respect to the joints of the other connecting bar plane, so that here the girder elements 60 require the projection 61 or 62 only on one of the side faces 15, 16. Thus, two types of girder elements 60 are required for this trussing in the case of the embodiment according to FIG. 7, to be precise ones with a projection 61 and ones with two projections 61, 62, which is indicated in FIG. 7 by the dashed representation of the projection 62. Here, the projections 61, 62 are somewhat wider than M in order to facilitate a telescopic guidance analogous to FIG. 4 in the case of this embodiment, as well.

Figure 8:
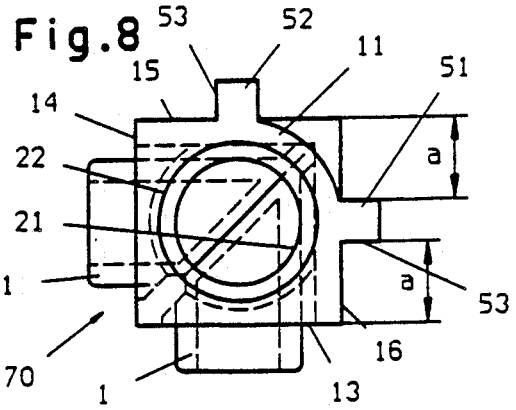

The variant of the girder element 70 having mutually perpendicular side faces 13, 14 which corresponds to the embodiment according to FIGS. 5 and 6 is represented in FIG. 8. Narrow projections 51, 52, which are continuous over the entire length of the element, have the same function as the projections 51, 52 of the embodiment according to FIGS. 5 and 6.

Figure 9:
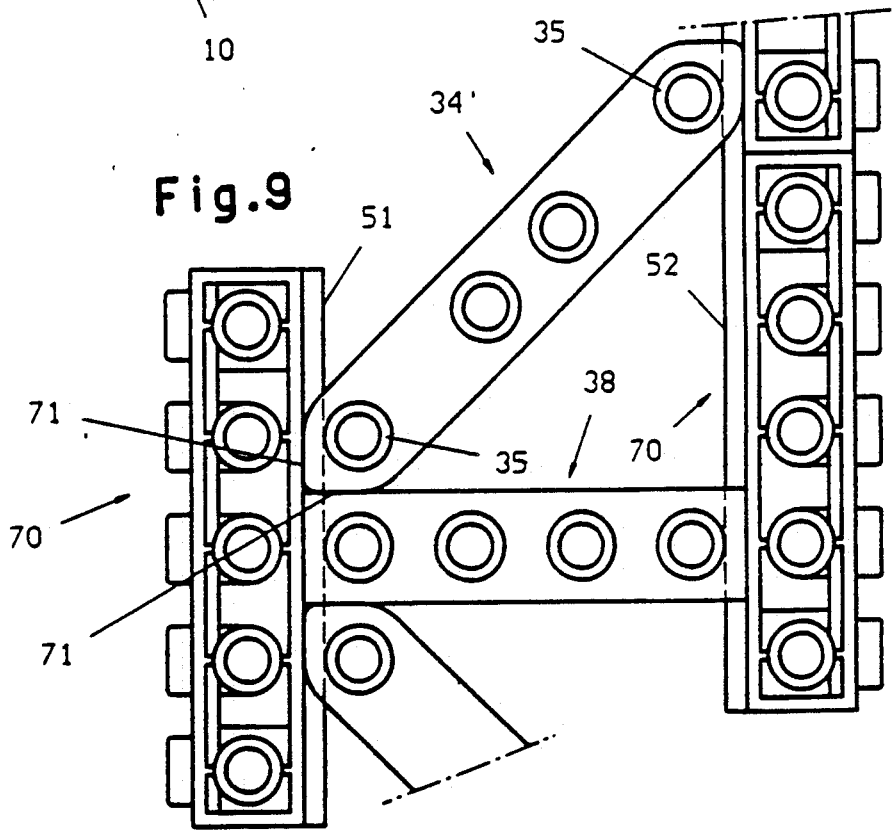
FIG. 9 shows a side view of a part of a further trussing.

Finally, FIG. 9 represents a part of a trussing having the girder elements 70 according to FIG. 8. As is apparent from FIG. 9, the embodiment having the narrow, smoothly continuous projections 51, 52 requires fewer differently configured girder elements. In the case of the embodiment according to FIG. 9, the connecting bars 34' have at their ends two bevels 71 at 45° to the longitudinal extent of the connecting bars 34'; the bevels 71 are each at a distance of 0.5 M from the center of the terminal pin 35. They facilitate the insertion of the connecting bars 34' in the correct position.

The building set described enables the building of stable trussings, something which has not previously been considered possible with a box of building blocks for building in layers. Owing to the described configuration of the girder elements, the forces in the bar are directed into the girder axis, since the bar axes intersect in the girder axes. Thus, the conditions at the joint correspond to the ideal trussing. Apart from the higher strength, this also yields an aesthetically optimal construction. Because the forces in the bar are directed into the girder axis, the girder element of length 5 M is so to speak the basic element. This length 5 M is unusual for boxes of building blocks for building in layers Here, only building blocks whose length is an even multiple of the modulus M are offered for lengths greater than 4 M.

We claim:

1. In combination with a building set of plug-in building blocks (44) for building in layers, having connecting elements (1) which are arranged in a square array of a modulus (M), and having corresponding mating connecting means (2); a plurality of prismatic girder elements (10, 50, 60, 70), which have centering means (21) on two opposite end faces (11, 12) for centering with further girder elements which join at the end faces, and at least one row each of connecting elements (1) with modular spacing on each of two first side faces (13, 14), said girder element further comprising at least one bar support face, said support face parallel and adjacent a said first side face.

2. The combination as claimed in claim 1, wherein the planes of the first side faces (13, 14) intersect at an angle of 90°.

3. The combination as claimed in claim 1, wherein two second side faces (15, 16) of the girder elements (10, 50, 60, 70) arranged perpendicular to the first side faces (13, 14) have a projection (17, 18; 51, 52; 61, 62) each, of which one bar supporting face (19, 53, 63) is parallel to the adjacent first side face (13, 14) and set back with respect to said adjacent first side face.

4. The combination as claimed in claim 3, wherein the set-back projection (17, 18; 51, 52) has the same spacing (a) from two mutually parallel opposite side faces (13, 15; 14, 16) of the girder element (10, 70).

5. The combination as claimed in claim 3, wherein the projections (51, 52) extend over the entire length of the girder elements (50, 70), and their width is less than the modules (M).

6. The combination as claimed in claim 3, wherein the projections (17, 18; 61, 62) have a width of at least one modulus (M), and have at least one further connecting element (1) each.

7. The combination as claimed in claim 6, wherein the first side faces (13, 14) overtop the projections (17, 18; 61, 62) on at least one side.

8. The combination as claimed in claim 7, wherein the first side faces (13, 14) each have a single row of at least five connecting elements (1), the projections (17, 18; 61, 62) have a single row of exactly three connecting elements (1), and the first side faces (13, 14) overtop the projections (17, 18; 61, 62) on both sides.

9. The combination as claimed in claim 1, wherein in at least one of the end faces (11, 12) the centering means comprise a bore hole (21) with a countersink (22) for accommodating a middle flange (29) of a plug element (28), and comprise, spaced from the end face (11, 12), a shoulder (24) for engaging a terminal bead (30) of the plug element (28).

10. The combination as claimed in claim 3, further comprising connecting bars (34, 34') with terminal connecting elements (35) which are arranged at both of the bars ends and whose mutual spacing is not integrally divisible by the modulus (M).

11. The combination as claimed in claim 10, wherein the thickness of the connecting bars (34, 34') is approximately equal to the spacing (a) between the first side faces (13, 14) and the bar supporting face of the adjacent set-back projection (17, 18; 51, 52; 61, 62).

12. The combination as claimed in claim 10, wherein the width of the connecting bars is substantially one modulus (M).

13. The combination as claimed in claim 10, wherein the connecting bars (34) are rounded at the ends, the roundings being coaxial with the terminal connecting elements (35).

14. The combination as claimed in claim 10, wherein at each of their ends the connecting bars (34') have two bevels (71) with an angle of 45° to the longitudinal extension of the bars.

15. The combination as claimed in claim 10, wherein between the terminal connecting elements (35) the connecting bars (34, 34') have further connecting elements (1) and mating connecting means (2) which are arranged symmetrically with respect to the middle plane of the connecting bars (34, 34') and are arranged at the modular spacing from one another.

16. The combination as claimed in claim 15, wherein the number of all connecting elements (1, 35) arranged on the connecting bars is equal to the number of the modular spacings between two girder elements (10, 50, 60, 70) arranged in parallel and connected to the connecting bars.

17. The combination as claimed in claim 1, wherein the planes of the first side faces (13, 14) intersect at an angle of 60°.

18. A toy building set for building trusses comprising:

(a) a plurality of girder elements (10, 50, 60, 70) having centering means (21) on two opposite end faces (11, 12) for centering with a further girder element which joins at the respective end face, at least one row each of connecting elements (1) spaced from each other with a regular spacing of a modulus (M) on two first side faces (13, 14), two second side faces (15, 16) arranged perpendicular to the first side faces (13, 14), and a projection each on the second side faces, a bar supporting face (19, 53, 63) of each projection being parallel to the adjacent first side face and set back with respect to the latter;

(b) a plurality of connecting bars (34, 34') with terminal connecting elements (35) similarly shaped as the connecting elements (1) of the girder elements (10, 50, 60, 70), the terminal connecting elements being arranged at both ends of the connecting bars and being spaced from each other by a distance that is not integrally divisible by the modulus (M), the thickness (a) of the connecting bars at their ends being substantially equal to the distance between the first side faces (13, 14) and the respective bar supporting faces (19, 53, 63) of the girder elements; and (c) a plurality of building blocks (44) having a plurality of mating connecting means (2) on one of their faces for plugging onto the connecting elements (1) of the girder elements (10, 50, 60, 70) and the terminal connecting elements (35) of the connecting bars (34, 34').

19. The building set as claimed in claim 18, wherein the planes of the first side faces (13, 14) intersect at an angle of 90°.

20. The building set as claimed in claim 18, wherein the planes of the first side faces (13, 14) intersect at an angle of 60°.

21. The building set as claimed n claim 18, wherein the set-back projection (17, 18; 51, 52) has the same spacing (a) from two mutually parallel opposite side faces (13, 15; 14, 16) of the girder elements (10, 70).

22. The building set as claimed in claim 18, wherein the projections (51, 52) extend over the entire length of the girder elements (50, 70), and their width is less than the modulus (M).

23. The building set as claimed in claim 18, wherein the projections (17, 18; 61, 62) have a width of at least one modulus (M), and have at least one further connecting element (1) each, and wherein said connecting bars (34) have further mating connecting means (36) coaxial to the terminal connecting elements (35) for plugging onto said further connecting element (1) of the projections.

24. The building set as claimed in claim 23, wherein the first side faces (13, 14) overtop the projections (17, 18; 61, 62) on at least one side.

25. The building set as claimed in claim 24, wherein the first side faces (13, 14) each have a single row of at least 5 connecting elements (1), the projections (17, 18; 61, 62) have a single row of exactly three connecting elements (1), and the first side faces (13, 14) overtop the projections (17, 18; 61, 62) on both sides.

26. The building set as claimed in claim 18, wherein in at least one of the end faces (11, 12) the centering means comprise a bore hole (21) with a countersink (22) for accommodating a middle flange (29) of a plug element (28), and comprise, spaced from the end face (11, 12), a shoulder (24) for engaging a terminal bead (30) of the plug element (28).

27. The building set as claimed in claim 18, wherein the width of the connecting bars is substantially one modulus (M).

28. The building set as claimed in claim 18, wherein the connecting bars (34) are rounded at the ends, the roundings being coaxial with the terminal connecting elements (35).

29. The building set as claimed in claim 18, wherein at each of their ends the connecting bars (34') have two bevels (71) with an angle of 45° to the longitudinal extension of the bars.

30. The building set as claimed in claim 18, wherein between the terminal connecting elements (35) the connecting bars (34, 34') have further connecting elements (1) and mating connecting means (2) which are arranged symmetrically with respect to the middle plane of the connecting bars (34, 34') and are arranged at the modular spacing from one another.

31. The building set as claimed in claim 30, wherein the number of all connecting elements (1, 35) arranged on the connecting bars is equal to the number of the modular spacings between two girder elements (10, 50, 60, 70) arranged in parallel and connected to the connecting bars.

* * * * *